US007938511B2

(12) United States Patent
Tomizawa et al.

(10) Patent No.: US 7,938,511 B2
(45) Date of Patent: May 10, 2011

(54) LIQUID EJECTION HEAD, INKJET PRINTING APPARATUS AND LIQUID EJECTING METHOD

(75) Inventors: Keiji Tomizawa, Yokohama (JP); Mikiya Umeyama, Tokyo (JP); Toru Yamane, Yokohama (JP); Chiaki Muraoka, Kawaguchi (JP); Yuichiro Akama, Kawasaki (JP); Masaki Oikawa, Inagi (JP); Tomotsugu Kuroda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 12/199,318

(22) Filed: Aug. 27, 2008

(65) Prior Publication Data

US 2009/0058949 A1 Mar. 5, 2009

(30) Foreign Application Priority Data

Aug. 30, 2007 (JP) ..... 2007-224023

(51) Int. Cl.
*B41J 2/05* (2006.01)

(52) U.S. Cl. ..... 347/61

(58) Field of Classification Search ..... 347/50.54, 347/57–59, 61–65, 40, 44, 20
See application file for complete search history.

(56) References Cited

U.S. PATENT DOCUMENTS

| | | | |
|---|---|---|---|
| 4,587,534 | A | 5/1986 | Saito et al. |
| 6,273,557 | B1 | 8/2001 | Milligan et al. |
| 6,354,698 | B1 | 3/2002 | Tachihara et al. |
| 6,447,102 | B1 | 9/2002 | Chen et al. |
| 6,652,079 | B2 | 11/2003 | Tsuchii et al. |
| 6,971,736 | B2 | 12/2005 | Tomizawa et al. |
| 6,984,025 | B2 | 1/2006 | Kaneko et al. |
| 6,984,026 | B2 | 1/2006 | Tomizawa et al. |
| 2004/0155928 | A1 | 8/2004 | Clark et al. |
| 2004/0218007 | A1 | 11/2004 | Tomizawa et al. |
| 2006/0192805 | A1 | 8/2006 | Eguchi et al. |
| 2007/0035580 | A1 | 2/2007 | Ide et al. |
| 2007/0195126 | A1 | 8/2007 | Kusunoki |

FOREIGN PATENT DOCUMENTS

| | | |
|---|---|---|
| CN | 1485206 | 3/2004 |
| EP | 0 110 534 | 6/1984 |
| EP | 1 380 419 | 1/2004 |
| JP | 11-188870 | 7/1999 |

(Continued)

OTHER PUBLICATIONS

Korean Office Action dated Jul. 27, 2010, issued in counterpart Korean Patent Application No. 10-2008-0084794, with and English translation.

*Primary Examiner* — K. Feggins
(74) *Attorney, Agent, or Firm* — Fitzpatrick, Cella, Harper & Scinto

(57) ABSTRACT

Provided are a printing head and an inkjet printing apparatus, which eject liquid droplets without leaving behind any bubble in each nozzle, thus having an enhanced durability. An ejection port of the printing head includes a first ejection port part communicating with the atmosphere and a second ejection port part having a cross-section orthogonal to an ejection direction being larger than a cross-section of the first ejection port part orthogonal to the ejection direction, and being formed between the energy effect chamber and the first ejection port part. In addition, the second ejection port part is formed to be eccentric to an electrothermal transducing element in an ink supply direction in which ink is supplied from an ink supplying port to the bubbling chamber.

10 Claims, 10 Drawing Sheets

FOREIGN PATENT DOCUMENTS

| | | | |
|---|---|---|---|
| JP | 2001-130005 | | 5/2001 |
| JP | 2006-231800 | | 9/2006 |
| KR | 10-2003-0084654 | A | 11/2003 |
| KR | 10-2004-0005693 | A | 1/2004 |
| RU | 2 221 701 | | 1/2004 |

LIQUID EJECTION HEAD, INKJET PRINTING APPARATUS AND LIQUID EJECTING METHOD

BACKGROUND OF THE INVENTION

1. Field of the Invention

The present invention relates to a liquid ejection head for ejecting ink droplets, an inkjet printing apparatus and a liquid ejecting method, and particularly relates to enhancement of the durability of a liquid ejection head.

2. Description of the Related Art

Ink ejecting methods applied to generally-used inkjet printing apparatuses include a method for ejecting ink droplets by using a liquid ejection head in which heat-generating elements, such as heaters, are arranged as ejection-energy generating elements. In this method, first, ink around a heat-generating element is instantaneously boiled by applying a voltage to an electrothermal transducing element functioning as the heat generating element. A phase change of the ink at the time of boiling creates an abrupt increase of pressure, so that ink droplets are ejected from the liquid ejection head. By ejecting ink droplets in this manner, the inkjet printing apparatus can finely control the ejection of ink droplets in response to an electric signal.

An ink ejecting method using the heat-generating elements, such as electrothermal transducing elements, has advantages that a large space is not needed to arrange the ejection-energy generating elements; the structure of the printing head is simple; and thus a large number of nozzles can be easily arranged in a smaller space, for example. For these reasons, a growing number of inkjet printing apparatuses using this ink ejecting method have been in use recently.

However, in a case where printing is performed by the ink ejecting method, the pressure of ink may abruptly change and induce cavitation upon bursting of a bubble made in the ink by the heat-generating element. If this abrupt pressure change occurs around any of the heat-generating elements, it is likely to make an impact on the heat-generating element. The impact adversely affects the durability of the heat-generating element. Methods have been proposed for preventing such an abrupt pressure change from deteriorating the durability of heat-generating elements, and one of the methods is to print with a printing head disclosed, for example, in Japanese Patent Application Publication No. Hei. 11-188870.

Japanese Patent Application Publication No. Hei. 11-188870 discloses a printing head which causes bubbles and the atmosphere to communicate with each other once the bubbles start to reduce their volume. In the case where printing is performed by ejecting ink droplets from the printing head disclosed in Japanese Patent Application Publication No. Hei. 11-188870, a portion of ink which immediately follows each ejected main droplet of ink has a component which tends to shrink toward the heat-generating element. This facilitates separation of the main droplet from the portion of ink which would turn into a satellite droplet if ejected. Accordingly, this mechanism makes it possible to separate satellite droplets in case the ink ejection is performed, from the main droplets, thereby checking the occurrence of the satellite droplets. Thus, the occurrence of the satellite droplets which are separated from main droplets is prevented and prevents occurrence of a mist of ink floating between the printing apparatus and the printing medium.

In general, in the printing head which causes bubbles and the atmosphere to communicate with each other in the process of growth and shrinkage of the bubbles, gas forming each bubble is discharged to the outside when the bubble and the atmosphere communicate with each other. As a result, once the bubble disappears, the amount of gas existing in the liquid decreases. This inhibits an abrupt change in pressure in the liquid, and accordingly enhances the durability of the heaters.

However, even if the printing head which causes bubbles and the atmosphere to communicate with each other in the process of growth and shrinkage of the bubbles is used, a bubble is sometimes left in the liquid after the liquid droplet is ejected, so that the bubble abruptly changes the pressure inside the bubbling chamber when it bursts.

FIG. 10A is a cross-sectional view of a nozzle in a printing head of a conventional atmosphere-communication type. The nozzle is viewed in the ejection direction. FIG. 10B is a cross-sectional view of the nozzle, taken along the line B-B of FIG. 10A. In the printing head in which bubbles and the atmosphere communicate with each other when the bubbles shrink, a bubble communicates with the atmosphere by contacting the meniscus which moves toward the heat-generating element when the liquid droplet is ejected. At this time, the meniscus moves almost symmetrically with respect to an axis perpendicularly passing the center of the heat-generation element and keeps its shape symmetrical. By contrast, the shape of the bubble is partially asymmetrical because of the shape of the nozzle. Because the ink passage extends toward the ink supplying port, there is no wall surface restricting the shape of the bubble in that direction. However, there is a wall surface forming the bubbling chamber in the far-end portion thereof at the side opposite to the ink supplying port. The wall surface located in the far-end portion of the bubbling chamber restricts the growth of the bubble. As a result, a part of a bubble located at the ink supplying port side in the bubbling chamber partially has a different shape from a part of the bubble located at the far-end portion opposite to the ink supplying port side. In sum, at the ink supplying port side in the bubbling chamber, the part of the bubble grows larger without having any restriction, thus having a relatively large grown part. In contrast, at the far-end portion of the bubbling chamber, the bubble has a relatively small grown part because the wall surface forming the bubbling chamber restricts the growth of the part of the bubble there.

When the liquid droplet is ejected with the bubble enlarging in this manner, then the meniscus moves toward the heat-generating element. In this situation, it is likely that, as shown in FIG. 10B, the atmosphere may communicate with the part of the bubble at the ink supplying port side, whereas the atmosphere may not communicate with the part of the bubble at the far-end portion. As a result, a split part of the bubble not communicating with the atmosphere is likely to remain at the far-end portion of the bubbling chamber. Furthermore, an abrupt pressure change may occur in the liquid existing inside the bubbling chamber when this split part of the bubble disappears, and accordingly an impact may be directed against the heat-generating element.

SUMMARY OF THE INVENTION

A liquid ejection head, an inkjet printing apparatus and an ejecting method provide for ejection of ink without leaving behind any bubble inside each nozzle. This is achieved by use of a liquid ejection head which has an improved durability by causing bubbles and the atmosphere to communicate with each other when ejecting the ink.

The present invention provides a liquid ejection head which causes bubbles and the atmosphere to communicate with each other. The durability of the liquid ejection head is enhanced by preventing bubbles from remaining in each bubbling chamber when a liquid is ejected. Thus, an impact directed against the corresponding heat-generating element is suppressed. In addition, the present invention is capable of providing an inkjet printing apparatus for printing by use of such a liquid ejection head.

DESCRIPTION OF THE EMBODIMENTS

Descriptions will be provided hereinbelow for a first embodiment for carrying out the present invention by use of the attached drawings.

Figure 1:
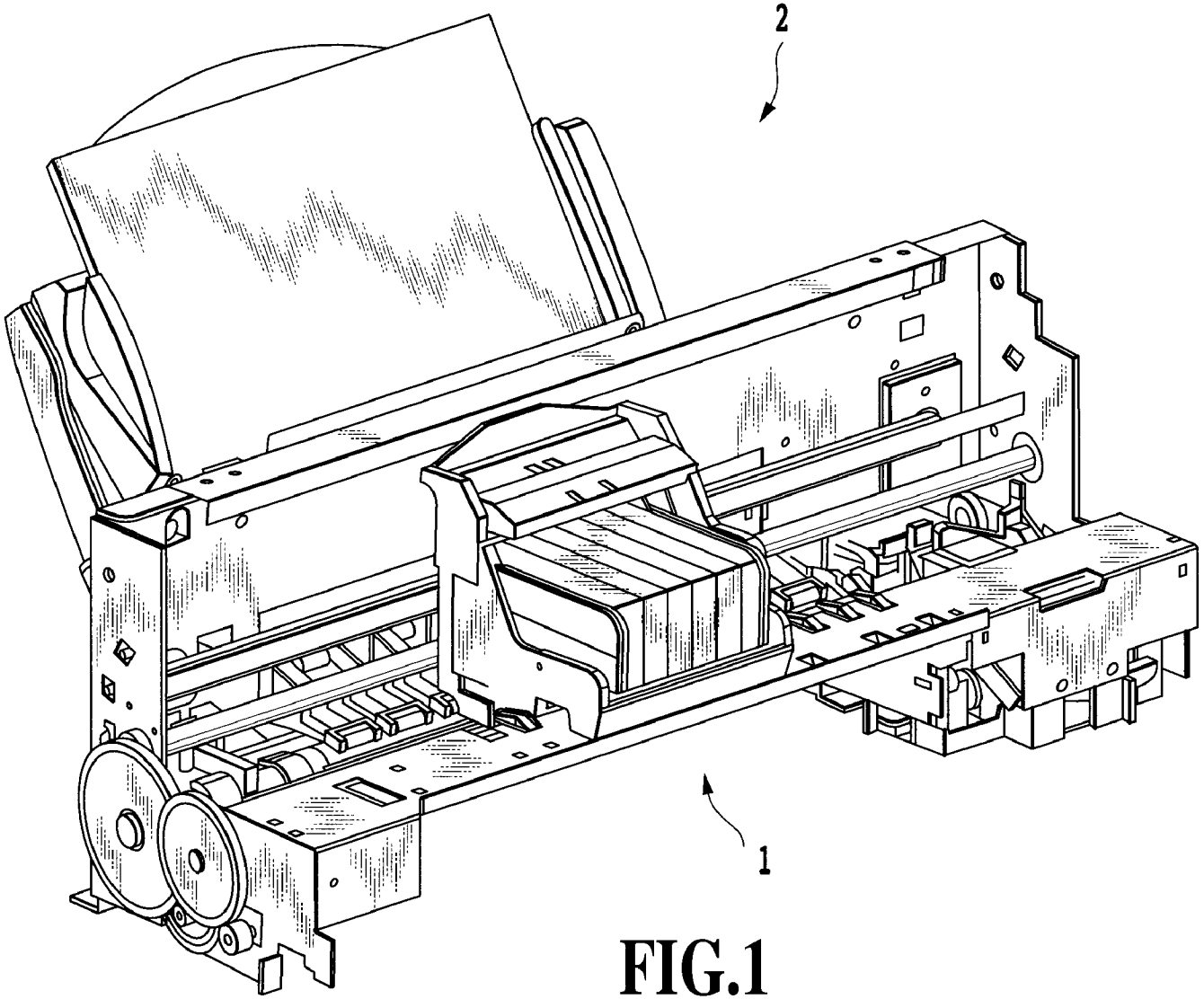
FIG. 1 is a perspective view of an inkjet printing apparatus using a printing head according to a first embodiment of the present invention.

FIG. 1 shows a perspective view of an inkjet printing apparatus 2 in which a printing head 1 of the first embodiment of the present invention is used as a liquid ejection head. Inkjet cartridges corresponding to multiple colors are mounted on the inkjet printing apparatus 2 with a carriage. Each inkjet cartridge is provided with a printing head 1 for ejecting ink to a printing medium.

Figure 2A:
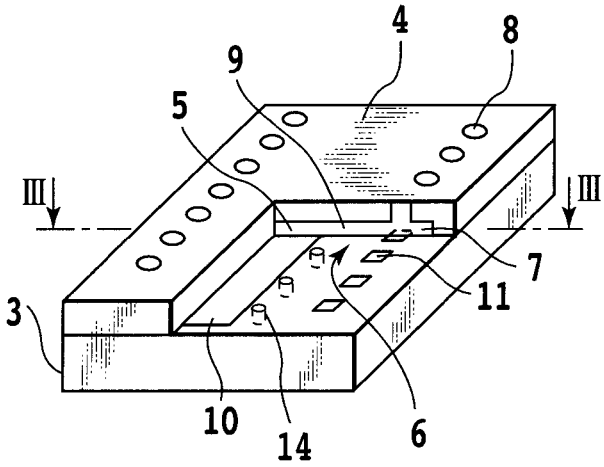
FIG. 2A is a partially cut-away, perspective view of the printing head according to the first embodiment of the present invention.
Figure 2B:
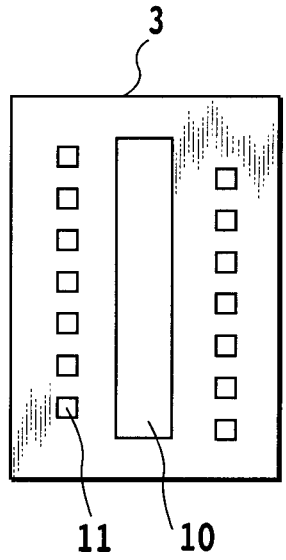
FIG. 2B is a plan view of a substrate of the printing head shown in FIG. 2A.

FIG. 2A shows a partially cut-away, perspective view of the printing head 1 used in the inkjet printing apparatus 2. As shown in FIG. 2A, the printing head 1 is formed by bonding an orifice plate 4 to a substrate 3. FIG. 2B shows a plan view of the substrate 3, which is one of the component parts constituting the printing head 1. A common liquid chamber 5 is formed between the substrate 3 and the orifice plate 4, and the common liquid chamber 5 temporarily reserves or stores ink as a liquid which turns into liquid droplets when ejected. In addition, multiple nozzles 6 through which ink is ejected are formed in the two side portions of the common liquid chamber 5 located between the substrate 3 and the orifice plate 4. Each nozzle 6 includes a bubbling chamber 7, an ejection port part 8 and an ink passage 9. The multiple nozzles 6 are arranged in parallel rows to form nozzle rows, and the nozzle rows are arranged extending in parallel, so that the nozzle rows sandwich an ink supplying port 10. A pair of the nozzle rows formed so as to sandwich the ink supplying port 10 is formed in a way that the ejection port parts 8 of the two rows are arranged in a staggering manner. The bubbling chamber 7 is formed in an end portion of each nozzle 6. The ink passage 9 is formed between the common liquid chamber 5 and the bubbling chamber 7 of each nozzle 6. The ink passage 9 introduces ink into the bubbling chamber 7.

Figure 3A:
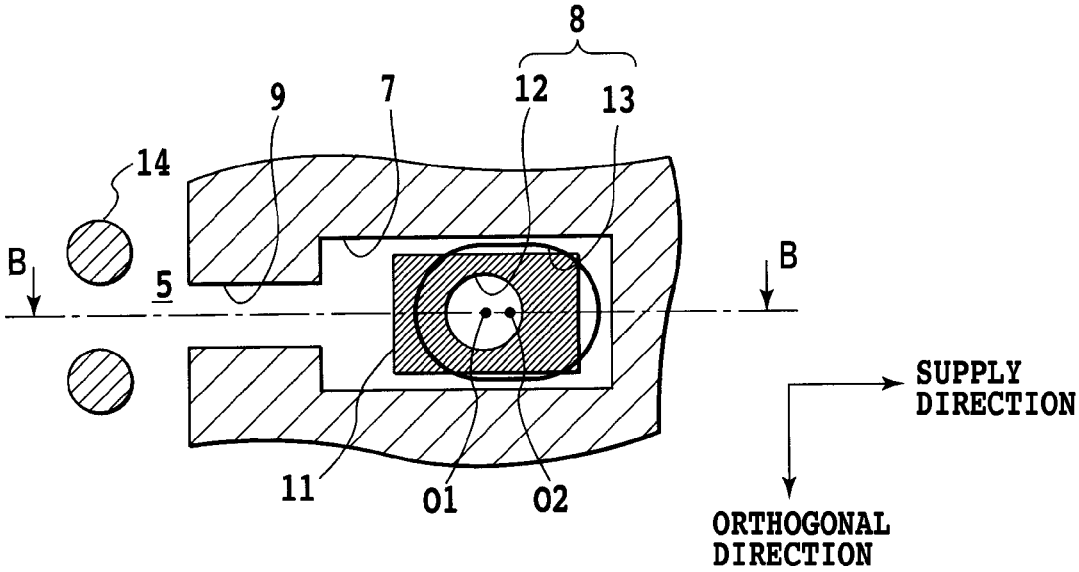
FIG. 3A is a cross-sectional view of the printing head shown in FIG. 2A viewed in the ejection direction.
Figure 3B:
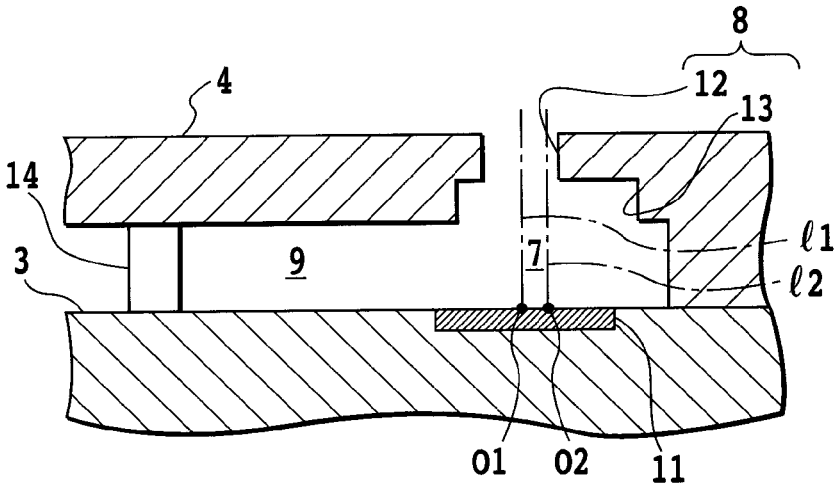
FIG. 3B is a cross-sectional view of the printing head taken along the B-B line of FIG. 3A.

FIGS. 3A, 3B show a cross-sectional view of the inside of the common liquid chamber 5 and one of the nozzles 6, both formed between the substrate 3 and the orifice plate 4. FIG. 3A is a cross-sectional view of one nozzle 6 and the common liquid chamber 5 viewed in the ejection direction. FIG. 3B is a cross-sectional view of the nozzle 6 and the common liquid chamber 5 viewed in a direction orthogonal to the ejection direction. Each of FIGS. 3A and 3B is the cross-sectional view of the nozzle 6 and the common liquid chamber 5, taken along the III-III line of the printing head 1 shown in FIG. 2A. Inside the common liquid chamber 5, multiple column-shaped nozzle filters 14 are arranged in the same direction as the nozzles 6. The nozzle filters 14 are arranged upstream of the ink passages 9 inside the common liquid chamber 5, preventing dusts and the like from flowing into the ink passages 9. In addition, the arrangement of these nozzle filters 14 between the substrate 3 and the orifice plate 4 prevents the orifice plate 4 from separating away from the substrate 3, and supports load coming from the orifice plate 4.

The ejection port parts 8 are formed to eject ink supplied from the common liquid chamber 5 to the inside of the corresponding bubbling chamber 7 in the orifice plate 4. The ejection port part 8 is an opening portion located in the front end of the nozzle 6 which is opened in order for ink droplets to be ejected from the bubbling chamber 7 to the atmosphere. In addition, the ink supplying port 10 is formed in the substrate 3 as a liquid supplying port, supplying ink to the common liquid chamber 5. The ink supplying port 10 extends in the same direction as the nozzles 6 in the nozzle rows are arranged. An electrothermal transducing element 11 is arranged on the substrate 3 inside the bubbling chamber 7. The location of the electrothermal transducing element 11 on the substrate 3 is opposed to the ejection port part 8. As a heat generating element, the electrothermal transducing element 11 generates thermal energy for ejecting ink. The bubbling chamber 7 is a component part where ink as a liquid is temporarily reserved, and where bubbles are generated by boiling the ink so that the bubbles thus generated impart kinetic energy to ink which is going to be ejected.

The ejection port parts 8 are formed in the printing head 1 of the present embodiment. Each ejection port part 8 ejects ink therethrough. The thermal energy is imparted to the ink by the electrothermal transducing element 11 inside the bubbling chamber 7, which is an energy effect chamber. In addition, each ejection port part 8 is formed to include a first ejection port part 12 and a second ejection port part 13. The first ejection port part 12 communicates with the atmosphere. The second ejection port part 13 is formed between the bubbling chamber 7 and the first ejection port part 12. The cross-section of the second ejection port part 12 in a direction orthogonal to the ejection direction is larger than the cross-section of the first ejection port part 12 in the direction orthogonal to the ejection direction. For explanatory convenience, a supply direction is defined as a direction in which ink is supplied from the common liquid chamber 5 to the inside of the bubbling chamber 7 in the ejection port part 8. An orthogonal direction is defined as being orthogonal to this supply direction, and as being the same as the direction in which the rows of the ejection port parts 8 and the ink supplying port 10 extend in the present embodiment.

Figure 4:
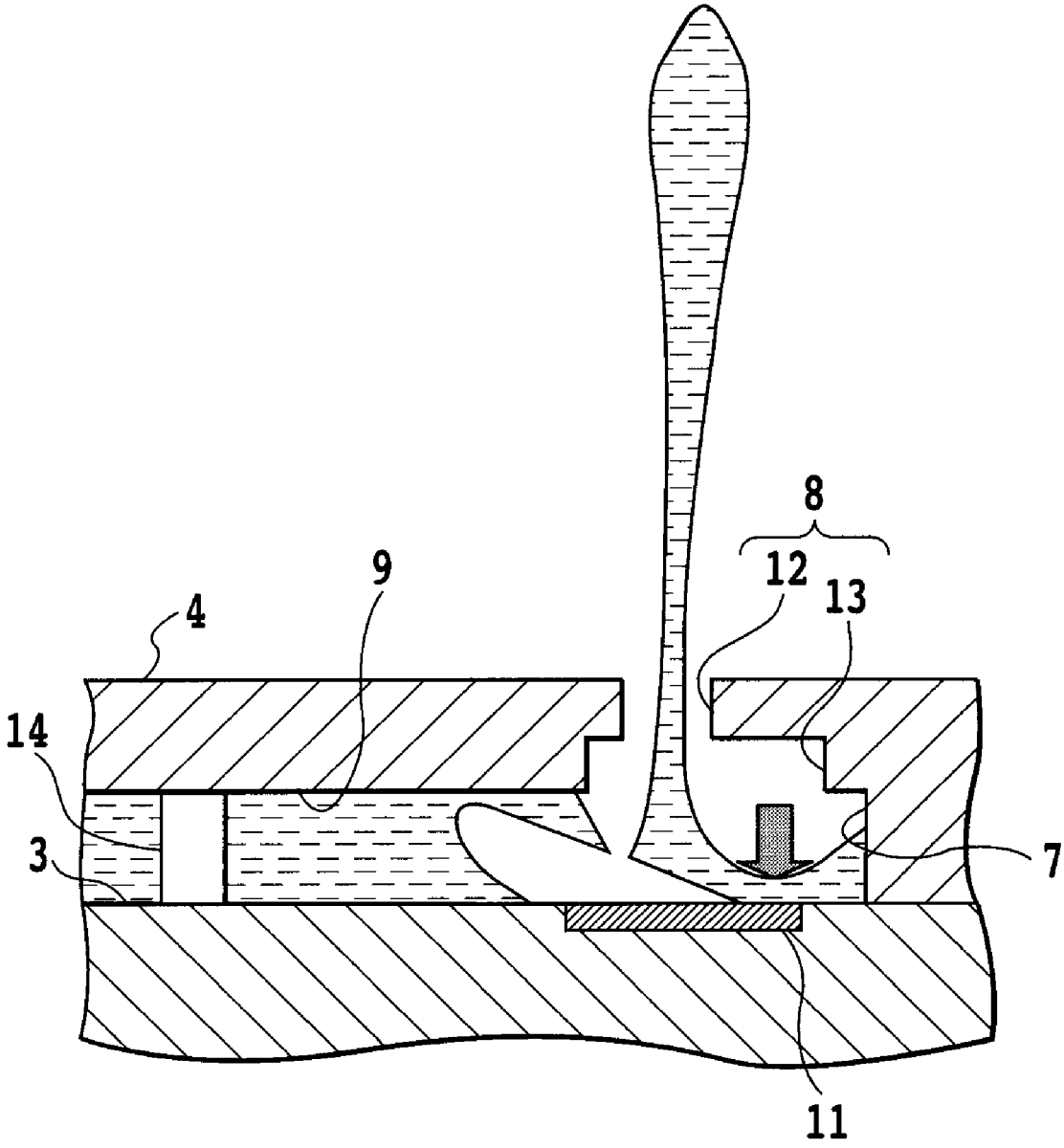
FIG. 4 is a cross-sectional view of the printing head shown in FIG. 2A ejecting a liquid droplet.

In the present embodiment, the center of the second ejection port part 13 in an ink supply direction, from the ink supplying port to the bubbling chamber 7, is offset from the center of the electrothermal transducing element 11 in the ink supply direction from the ink supplying port to the bubbling chamber 7, toward a far-end side of the bubbling chamber 7 in the ink supply direction from the ink supplying port to the bubbling chamber. Here, the ink supply direction is a direction in which ink is supplied from the ink supplying port 10 to the bubbling chamber 7. In contrast, the respective centers of the electrothermal transducing element 11 and the first ejection port part 12 are not offset from each other. That is to say, the two centers are set at the same location. As a result, the center of the second ejection port part 13 is arranged to be eccentric to the center of the first ejection port part 12. FIG. 4 shows a cross-sectional view of the nozzle 6 of the present embodiment, which is shown in FIG. 3B, and which is ejecting a liquid droplet. In this respect, reference numeral 01 denotes the center of the electrothermal transducing element 11 as shown in FIGS. 3A and 3B. Reference numeral 11 denotes a line extending from the center of the electrothermal transducing element 11 in the ejection direction. In addition, reference numeral 12 denotes a line which extends in the ejection direction, and which passes the center of the second ejection port part 13. Reference numeral 02 denotes a point at which the line 12 crosses over the bottom surface of the bubbling chamber 7. In other words, reference numeral 02 denotes a point obtained by projecting the center of the second ejection port part 13 to a plane on which the bottom surface of the bubbling chamber 7 exists. The centers 01 and 02 of the respective spaces are shown in each of FIGS. 3A and 3B. In this respect, a "center" is defined as a center of gravity of a space which is filled with a homogeneous mass. As shown in FIG. 3A, when the nozzle 6 is viewed in the ejection direction, the center 02 of the second ejection port part 13 is offset from the center 01 of the electrothermal transducing element 11 in the supply direction. In the present embodiment, the hole of the second ejection port part 13 is formed to have an ellipse-shaped cross-section orthogonal to the ejection direction. Furthermore, the second ejection port part 13 is shaped like an ellipse which is formed long in the supply direction with a long axis extending in the supply direction and with a short axis extending in the orthogonal direction.

A description will be provided for how the printing head 1 behaves, when the printing head 1 of the present embodiment is used for ejecting ink.

Once the electrothermal transducing element 11 is energized, the electrothermal transducing element 11 generates heat through converting electric energy to heat. Thereby, inside the bubbling chamber 7 facing the electrothermal transducing element 11, ink situated on the electrothermal transducing element 11 is instantaneously boiled, and a bubble is thus generated. Once the bubble is generated in the bubbling chamber 7, ink inside the bubbling chamber 7 is pushed back due to an abrupt increase of pressure caused by the change of the ink from a liquid phase to a gaseous phase, and ink situated above the electrothermal transducing element 11 is pressed and moved. Subsequently, the ink moving inside the bubbling chamber 7 is pressed toward the ejection port part 8 by the bubble thus generated, and the ink is ejected from the ejection port part 8. The ink ejected from the ejection port part 8 impacts in a predetermined position on the printing medium.

In the present embodiment, because the center of the second ejection port part 13 is arranged to be eccentric to the center of the electrothermal transducing element 11 in the supply direction, the second ejection port part 13 is formed asymmetrical with respect to the center of the electrothermal transducing element 11. In other words, a portion on the ink-supplying-side of the center of the electrothermal transducing element 11 (hereinafter referred to as "a first portion of the second ejection port 13") is formed to be relatively large. The other portion of the second ejection port part 13 on the other side (side opposite to the ink-supplying- side) of the center of the electrothermal transducing element 11 (hereinafter referred to as "a second portion of the second ejection port part 13") is formed to be relatively small. For this reason, the fluidity of ink inside the second ejection port part 13 is different between the first and second portions of the second ejection port part 13.

With regard to ink reserved in the first portion of the second ejection port part 13, the amount of ink reserved in a location relatively far away from the wall surface defining the second ejection port part 13 is relatively larger. For this reason, the ink reserved in the first portion of the second ejection port part 13 is less affected by resistance from the wall surface while the ink is flowing, and the fluidity of this ink is accordingly higher. By contrast, with regard to ink reserved in the second portion of the second ejection port part 13, the amount of ink reserved in a location relatively near the wall surface is relatively larger. For this reason, the ink reserved in the second portion of the second ejection port part 13 is more affected by resistance from the wall surface while the ink is moving, and the fluidity of this ink is accordingly lower. As a result, after ink is ejected, while the meniscus is moving toward the electrothermal transducing element 11, the amount of movement of the meniscus is different between the ink-supplying-side of the center of the electrothermal transducing element 11 and the other side of the center of the electrothermal transducing element 11.

Having a higher fluidity, the ink reserved in the ink-supplying-side of the center of the electrothermal transducing element 11 has a meniscus moving toward the electrothermal transducing element 11 by an amount per unit time larger than the ink reserved in the other side of the ink supply direction. As a result, when the bubble and the atmosphere communicate with each other, ink reserved in the first portion of the second ejection port part 13 moves more than ink reserved in the second portion of the second ejection port part 13.

At this time, the bubble generated by the drive of the electrothermal transducing element 11 grows asymmetrically because the ink passage inside the nozzle 6 is formed into the shape asymmetrical with respect to the axis of the electrothermal transducing element 11. Specifically, a part of the bubble located in the other side of the ink supply direction, grows relatively more easily, and is accordingly formed relatively larger than the ink-supplying-side of the center of the electrothermal transducing element 11. As a result, while ink is in the process of being ejected, the moving meniscus and the part of the bubble communicate with each other at the location in the other side of the ink supply direction of the center of the electrothermal transducing element 11.

In this respect, if the nozzle 6 had a shape in which the second ejection port part 13 is concentric with the electrothermal transducing element 11 in both the supply direction and in the orthogonal direction, a small bubble would remain in a space located in the ink-supplying-side of the center of the electrothermal transducing element 11. Accordingly, the remaining bubble would adversely affect the durability of the electrothermal transducing element 11 by directing an impact against the electrothermal transducing element 11 when the bubble disappears.

In the present embodiment, however, the second ejection port part 13 is formed to be eccentric to the electrothermal transducing element 11 in the supply direction. For this reason, when the meniscus moves toward the electrothermal transducing element 11, a part of the meniscus which gets closest to the bottom surface of the bubbling chamber 7 is situated in a location beyond an end portion of the bubble in the supply direction. As a result, the meniscus which moves more in the ink-supplying-side of the center of the electrothermal transducing element 11 crushes a part of the bubble located in ink-supplying-side of the center of the electrothermal transducing element 11. Accordingly, the part of the bubble is pushed out toward the other side of the ink supply direction. Consequently, as shown in FIG. 4, the bubble overall moves toward the other side of the ink supply direction, and thus is not split which would otherwise occur due to the meniscus moving toward the electrothermal transducing element 11. Resultantly, no bubble remains in the space located in the ink-supplying-side of the center of the electrothermal transducing element 11, and the part of the bubble which is originally located in the ink-supplying-side of the center of the electrothermal transducing element 11 merges into the remaining part of the bubble located in the other side of the ink supply direction of the center of the electrothermal transducing element 11. Eventually, a relatively large bubble is formed.

The bubble thus formed communicates with the atmosphere at the location in the other side of the ink supply direction of the center of the electrothermal transducing element 11. Thereby, gas that forms the bubble is released into the atmosphere. This makes it likely that no gas may be left behind in the ink reserved in the bubbling chamber 7. As shown in FIG. 4, this prevents the bubble from remaining in the space located in the ink-supplying-side of the center of the electrothermal transducing element 11, and the gas enclosed in the bubble formed in the ink reserved in the bubbling chamber 7 is released into the atmosphere by the communication of the bubble with the atmosphere. This release prevents the bubble from being left behind in the ink reserved in the bubbling chamber 7, and accordingly makes it possible to prevent an impact from being directed against the surface of the electrothermal transducing element 11. Prevention of the impact makes it possible to enhance the durability of the electrothermal transducing element 11, and resultantly makes it possible to enhance the durability of the printing head 1. Furthermore, it is possible to enhance the durability of the inkjet printing apparatus 2 for which the printing head 1 is used.

Second Embodiment

Figure 5A:
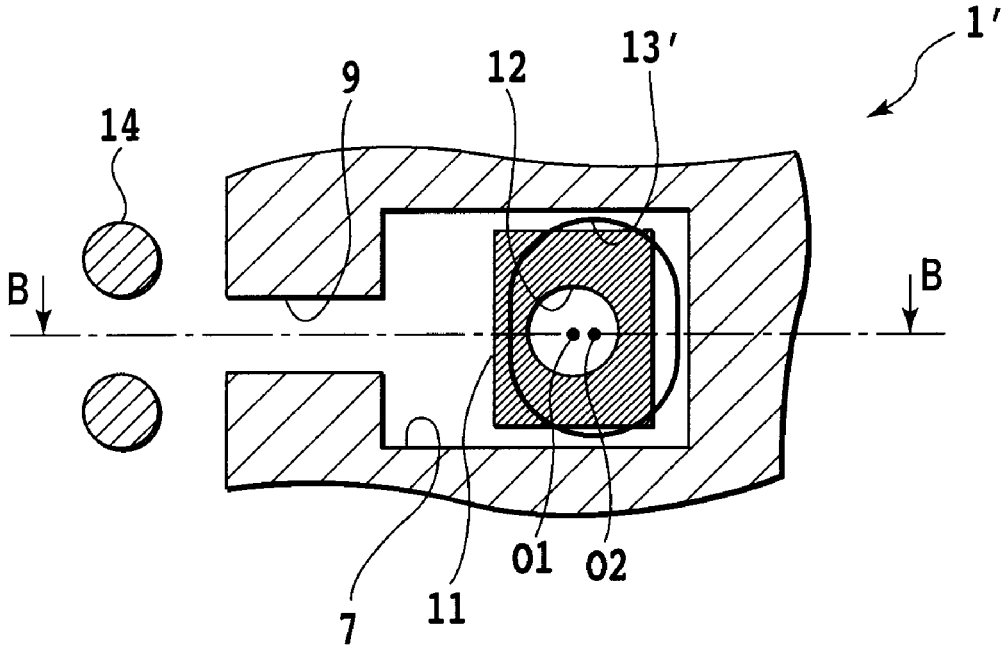
FIG. 5A is a cross-sectional view of a printing head according to a second embodiment of the present invention viewed in the ejection direction.
Figure 5B:
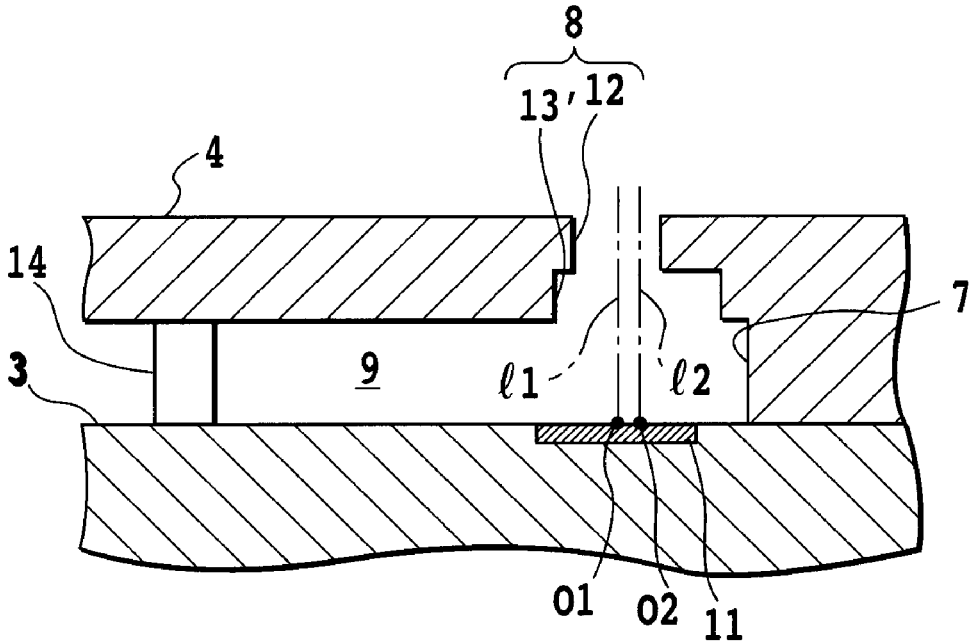
FIG. 5B is a cross-sectional view of the printing head taken along the B-B line of FIG. 5A.

Next, a description will be provided for a printing head 1' of a second embodiment by use of FIGS. 5A and 5B. Component parts which can be configured in the same manner as those of the first embodiment are denoted by the same reference numerals in FIGS. 5A, 5B, and descriptions for those component parts will be omitted, and be provided for only component parts which are different from those of the first embodiment.

FIG. 5A shows a cross-sectional view of the printing head 1' of the second embodiment viewed in the ejection direction. FIG. 5B shows a cross-sectional view of the printing head 1' of the second embodiment taken along the B-B line of FIG. 5A. The second ejection port part is shaped like an ellipse in each printing head 1' of the present embodiment and the printing head 1 of the first embodiment. However, the orientation of the long and short axes of the second ejection port part 13' in the printing head 1' is different from that of the second ejection port part 13 in the printing head 1. In the case of the printing head 1 of the first embodiment, the second ejection port part 13 has the long axis extending in the supply direction and the short axis extending in the orthogonal direction. In the case of the printing head 1' of the second embodiment, the second ejection port part 13' has a long axis extending in the orthogonal direction and a short axis extending in the supply direction. In the present embodiment, as described above, the cross-section of the second ejection port part 13' in a direction orthogonal to the ejection direction is shaped with its projected diameter orthogonal to the supply direction being longer than its projected diameter in the supply direction on the plane on which the bottom surface of the bubbling chamber is located.

As a result, the electrothermal transducing element 11' is shaped with its length in the orthogonal direction being longer than its length in the supply direction. The second ejection port part 13' and the electrothermal transducing element 11' may be shaped as shown for the second embodiment.

Third Embodiment

Figure 6A:
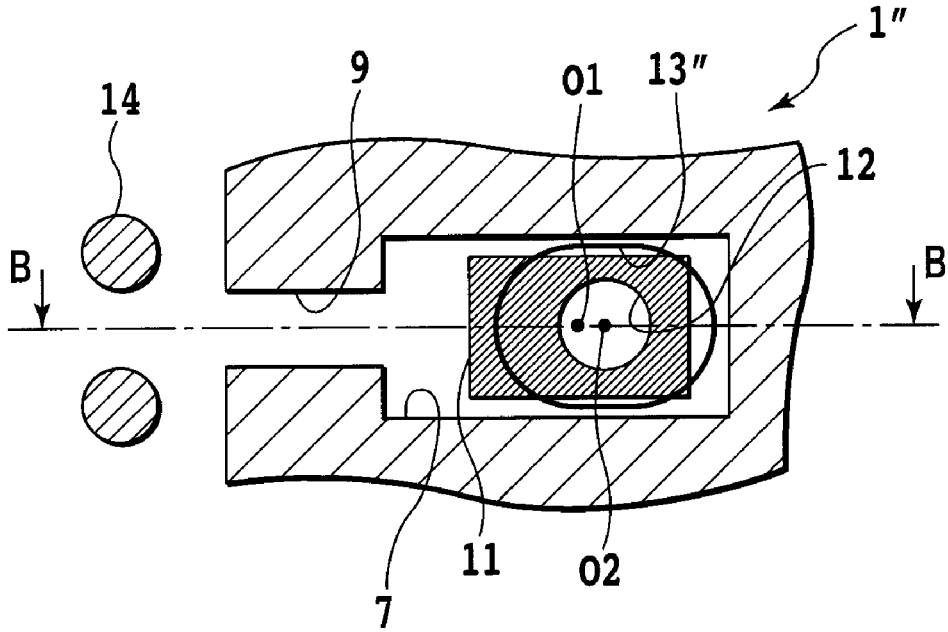
FIG. 6A is a cross-sectional view of a printing head according to a third embodiment of the present invention viewed in the ejection direction.
Figure 6B:
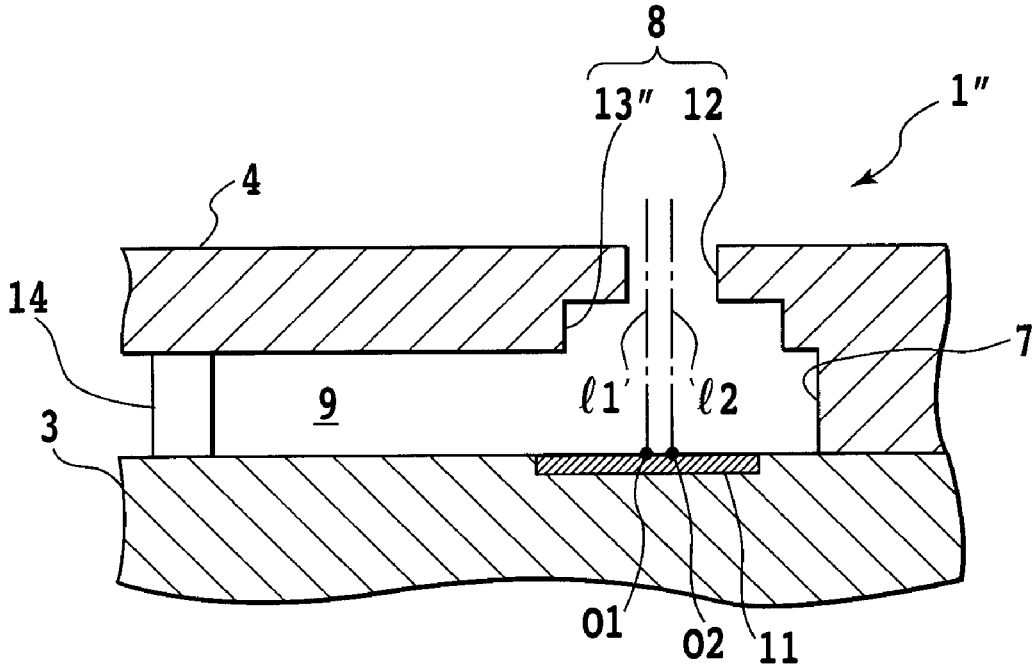
FIG. 6B is a cross-sectional view of the printing head taken along the B-B line of FIG. 6A.

Next, descriptions will be provided for a printing head 1" of a third embodiment by use of FIGS. 6A and 6B. FIG. 6A shows a cross-sectional view of the printing head 1" of the third embodiment viewed from the ejection direction. FIG. 6B shows a cross-sectional view of the printing head 1" of the third embodiment, taken along the B-B line of FIG. 6A. In FIGS. 6A and 6B, component parts which can be configured in the same manner as those of the first and second embodiments are denoted by the same reference numerals. Descriptions will be omitted for those component parts, and be provided for component parts of the third embodiment which are different from those of the first and second embodiments.

In the case of the printing head 1 of the first embodiment, the center of the second ejection port part 13 is offset from the respective centers of the first ejection port part 12 and the electrothermal transducing element 11. By contrast, in the case of the printing head of the present embodiment, the first ejection port part 12 and the second ejection port part 13" are formed in a way that their respective centers correspond with each other in the supply direction and in the orthogonal direction. In addition, the centers 02 of the first ejection port part 12 and the second ejection port part 13" thus corresponding with each other are offset from the center 01 of the electrothermal transducing element 11 in the supply direction. Because the ejection port part 8 is thus formed, the meniscus is not formed one-sided and moves toward the electrothermal transducing element 11 while keeping its shape symmetrical with respect to the respective centers of the first ejection port part 12 and the second ejection port part 13", when a liquid droplet is ejected.

This movement prevents a liquid droplet from being affected by a force created by the shape of the meniscus which would be otherwise asymmetrical. As a result, the liquid droplet is ejected straight in the ejection direction. This straight ejection makes the ejected droplet impact exactly in a predetermined position, and thus the liquid-droplet-impacting precision of the printing head 1" is kept high.

Figure 7:
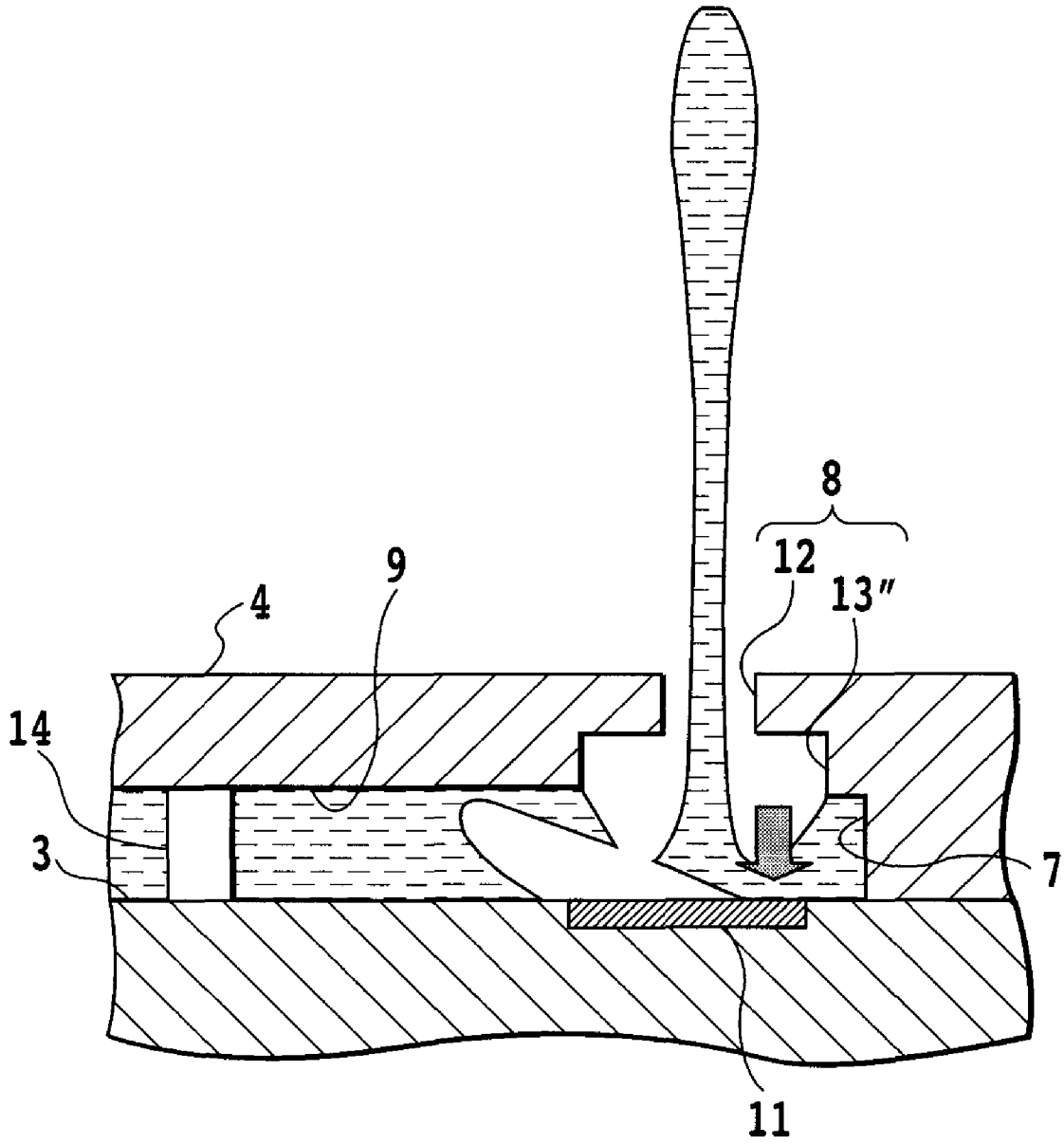
FIG. 7 is a cross-sectional view of the printing head shown in FIGS. 6A, 6B ejecting a liquid droplet.

At this time, a bubble is generated on the electrothermal transducing element 11. The bubble thus generated contacts and communicates with the meniscus moving toward the electrothermal transducing element 11. In this respect, because the centers respectively of the first ejection port part 12 and the second ejection port part 13" are offset from the center of the electrothermal transducing element 11 in the supply direction, the meniscus contacts, and subsequently communicates with, the bubble in a way that the meniscus is offset from the center of the bubble in the supply direction. As a result, when the meniscus comes closer to the electrothermal transducing element 11 after its movement, a part of the meniscus closest to the bottom surface of the bubbling chamber 7 in a location beyond the center of the ejection port part 8 in the supply direction is situated in a location beyond an end portion of the bubble in the supply direction. FIG. 7 shows a cross-sectional view of the inside of the nozzle 6 through which a liquid droplet is about to be ejected. Because, shown in FIG. 7, the part of the meniscus closest to the bottom surface of the bubbling chamber 7 is situated in the location beyond the end portion of the bubble in the supply direction, the bubble is pushed in a direction opposite to the supply direction when the meniscus moves toward the electrothermal transducing element 11. This push prevents the bubble from being split, and thus prevents a split part of the bubble from being left behind in a part of the ejection port part 8 lying beyond the center of the electrothermal transducing element 11 in the supply direction.

Because a part of the bubble is prevented from being left behind inside the bubbling chamber 7, this makes it possible to prevent the surface of the electrothermal transducing element 11 from receiving an impact which would otherwise occur due to an abrupt pressure change when the bubble disappears. This prevention makes it possible to enhance the durability of the electrothermal transducing element 11, and consequently to enhance the durability of the printing head 1". Furthermore, this makes it possible to enhance the durability of the inkjet printing apparatus 2 using the printing head 1".

In the case of the printing head 1", as described above, it is possible to prevent the bubble from remaining inside the bubbling chamber 7, and thereby enhancing the durability of the electrothermal transducing element 11, as well as inhibiting the deterioration of the impacting precision of the liquid droplet.

Fourth Embodiment

Figure 8A:
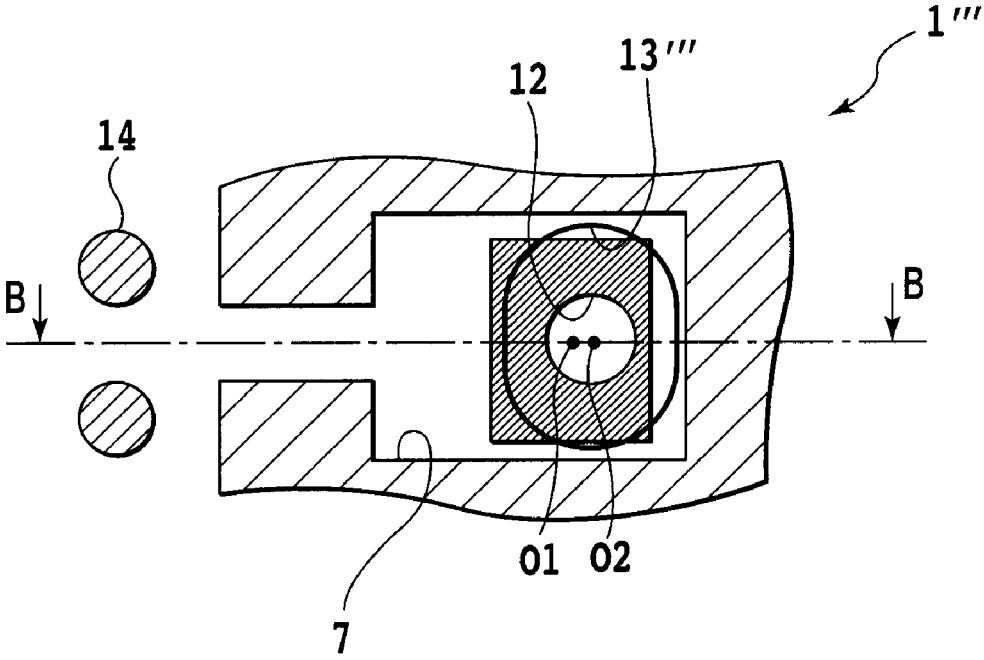
FIG. 8A is a cross-sectional view of a printing head according to a fourth embodiment of the present invention viewed in the ejection direction.
Figure 8B:
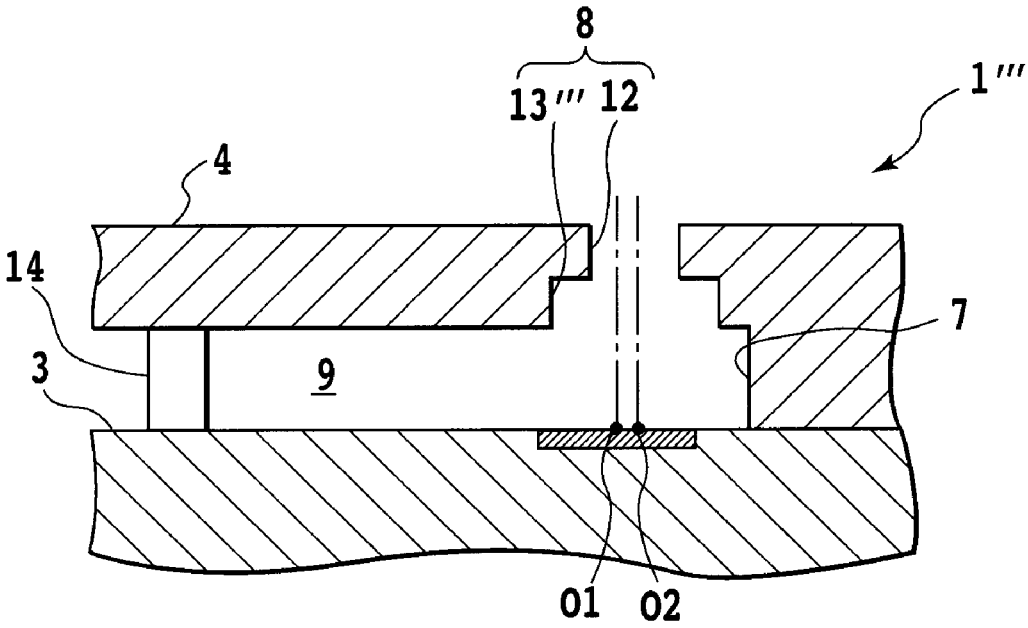
FIG. 8B is a cross-sectional view of the printing head taken along the B-B line of FIG. 8A.

Next, a description will be provided for a printing head 1'" of a fourth embodiment by use of FIGS. 8A and 8B. FIG. 8A shows a cross-sectional view of the printing head 1'" of the fourth embodiment viewed in the ejection direction. FIG. 8B shows a cross-sectional view of the printing head 1'" of the fourth embodiment, taken along the B-B line of FIG. 8A. In FIGS. 8A, 8B, component parts which can be configured in the same manner as those of the first to third embodiments are denoted by the same reference numerals. Descriptions will be omitted for those component parts, and be provided for component parts of the fourth embodiment which are different from those of the first to third embodiments.

In the case of the printing head 1" of the third embodiment, the second ejection port part 13" is shaped like an ellipse which has a long axis extending in the supply direction. By contrast, the printing head 1'" of the present embodiment is different from the printing head 1" of the third embodiment in that the second ejection port part 13'" is shaped like an ellipse which has a long axis extending in the orthogonal direction and a short axis extending in the supply direction.

In addition, in the present embodiment, the electrothermal transducing element 11 is formed with its length in the orthogonal direction longer than its length in the supply direction, in response to the second ejection port part 13'" being formed with its length in the orthogonal direction longer than its length in the supply direction. The second ejection port part 13'" and the electrothermal transducing element 11 may be formed in this manner.

Other Embodiments

It should be noted that the liquid ejection head of the present invention can be installed in machines such as printers, copying machines, facsimile machines including a communications system, and word processors including a printer part, as well as industrial printing machines combined with various processing machines. Use of this type of the liquid ejection head makes it possible to print on various printing media including paper, thread, fiber, cloth, leather, metals, plastics, glass, wood, and ceramics. It should be noted that the term "printing" used in the description is defined as imparting not only meaning-carrying images such as characters and figures but also images which carry no meaning, such as patterns, to various printing media.

In addition, the terms "ink" and "liquid" used in the description should be widely construed as being substances which go beyond their literal meanings. The terms "ink" and "liquid" are defined as being substances used to form images, designs, patterns and the like, and to process printing media, as well as to treat ink and printing media, through their application onto the printing media. In this respect, enhancing the fixing property of ink applied to printing media through its solidification or insolubilization, and enhancing the printing quality and color development of the ink, as well as enhancing the image durability, are examples of treating ink and printing media.

Figure 9A:
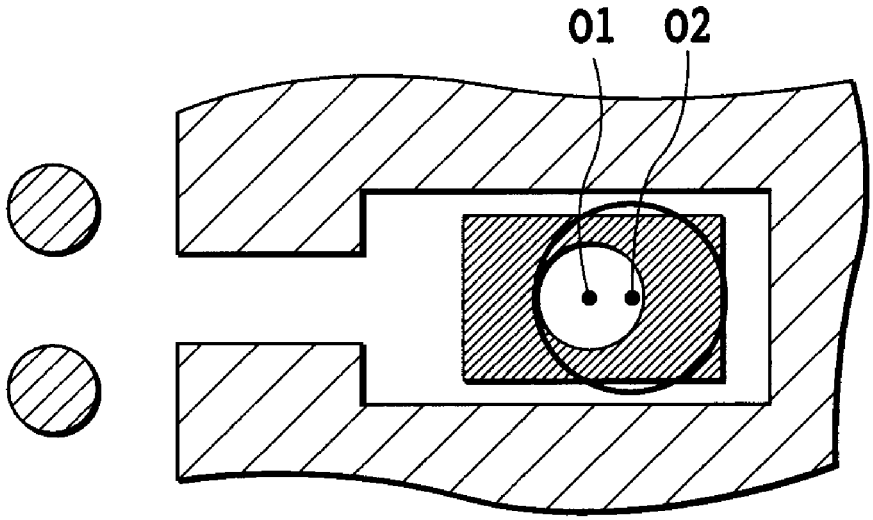
FIGS. 9A and 9B are cross-sectional views of printing heads according to the other embodiments of the present invention viewed in their ejection directions, respectively.
Figure 9B:
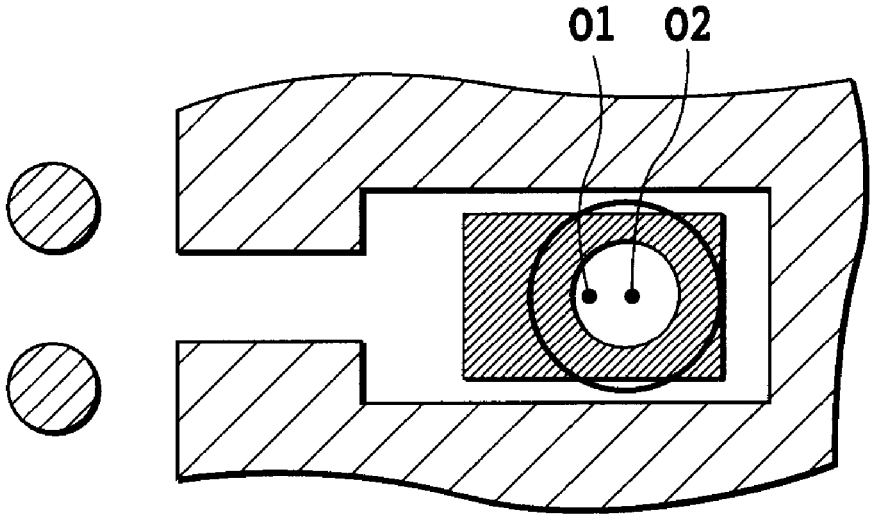
Figure 10A:
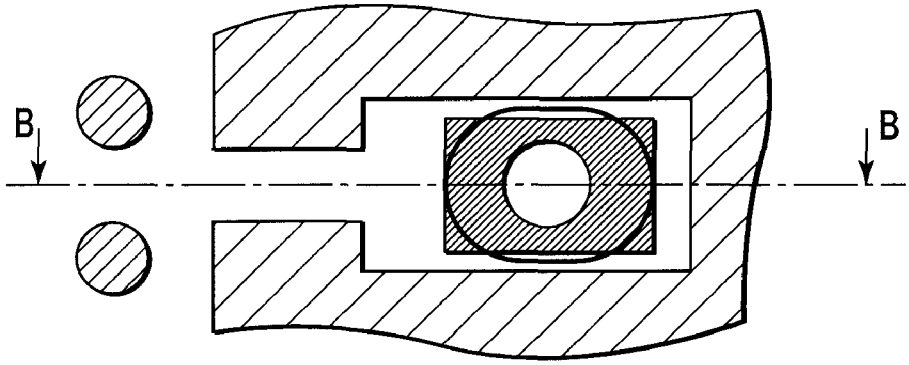
FIG. 10A is a cross-sectional view of a printing head of a conventional type viewed in the ejection direction.
Figure 10B:
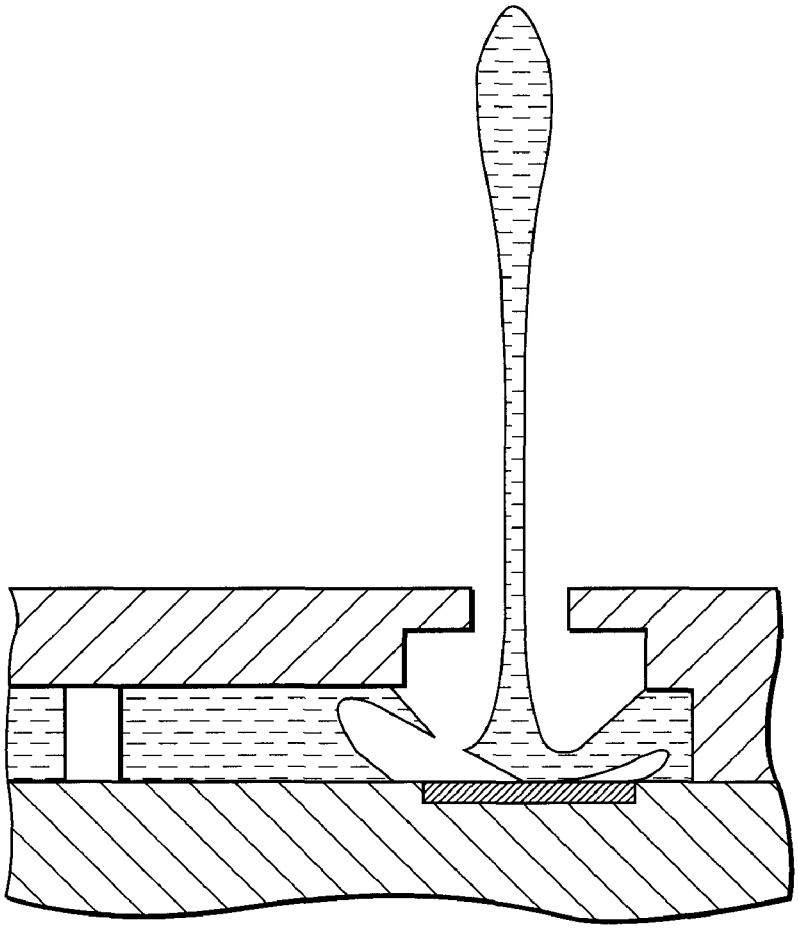
FIG. 10B is a cross-sectional view of the printing head taken along the B-B line of FIG. 10A.

In the case of the foregoing embodiments, the cross-section of the second ejection port part in the direction orthogonal to the ejection direction is shaped in an ellipse. As shown in FIGS. 9A and 9B, instead, the cross-section of the second ejection port part in the direction orthogonal to the ejection direction may be shaped like a circle instead. In this case, as shown in FIG. 9A, only the second ejection port part may be formed to be offset from the first ejection port part and the electrothermal transducing element in the supply direction. Alternatively, as shown in FIG. 9B, the first and second ejection port parts may be formed to be offset from the electrothermal transducing element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-224023, filed Aug. 30, 2007, which is hereby incorporated by reference herein in its entirety.

What is claimed is:

1. A liquid ejection head comprising:

an ejection port part for ejecting liquid;

a heat generating element for generating heat energy used for ejecting liquid, the heat generating element being formed at a location directly opposed to the ejection port part;

an energy effect chamber in which the heat generating element is located;

a channel communicating with the energy effect chamber; and a liquid supplying port communicating with the channel and supplying liquid to the energy effect chamber, wherein the ejection port part includes a first ejection port part communicating with atmosphere and a second ejection port part having a cross-sectional area orthogonal to a direction in which liquid is ejected that is greater than that of the first ejection port part, the second ejection port part being located between the energy effect chamber and the first ejection port part, and wherein a center of the second ejection port part, in a liquid supply direction from the liquid supplying port to the energy effect chamber, is offset from a center of the heat generating element in the liquid supply direction toward a far-end side of the energy effect chamber in the liquid supply direction.

2. The liquid ejection head according to claim 1, wherein the center of the first ejection port part and the center of the heat generating element correspond with each other in the liquid supply direction and a direction orthogonal to the liquid supply direction.

3. The liquid ejection head according to claim 1, wherein a center of the first ejection port part in the liquid supply direction is offset from the center of the heat generating element in the liquid supply direction toward the far-end side of the energy effect chamber in the liquid supply direction.

4. The liquid ejection head according to claim 3, wherein the center of the first ejection port part and the center of the second ejection port part correspond with each other in the liquid supply direction and in a direction orthogonal to the liquid supply direction.

5. The liquid ejection head according to claim 1, wherein a cross-section of the second ejection port part orthogonal to the ejection direction is formed in the shape of a circle.

6. The liquid ejection head according to claim 1, wherein a cross-section of the second ejection port part orthogonal to the ejection direction is formed in the shape of an ellipse.

7. The liquid ejection head according to claim 6, wherein a dimension of the cross-section of the second ejection port part orthogonal to the ejection direction in a direction orthogonal to the liquid supply direction is shorter than a dimension of the cross-section in the liquid supply direction.

8. The liquid ejection head according to claim 6, wherein a dimension of the cross-section of the second ejection port part orthogonal to the ejection direction in a direction orthogonal to the liquid supply direction is longer than a dimension of the cross-section in the liquid supply direction.

9. An inkjet printing apparatus comprising a liquid ejection head and a member for mounting the liquid ejection head, the liquid ejection head including:

an ejection port part for ejecting liquid;

a heat generating element for generating heat energy used for ejecting liquid, the heat generating element being formed at a location directly opposed to the ejection port part;

an energy effect chamber in which the heat generating element is arranged;

a channel communicating with the energy effect chamber; and a liquid supplying port communicating with the channel and supplying liquid to the energy effect chamber, wherein the ejection port part includes a first ejection port part communicating with atmosphere, and a second ejection port part having a cross-sectional area orthogonal to a direction in which liquid is ejected that is greater than that of the first ejection port part, the second ejection port part being located between the energy effect chamber and the first ejection port part, and wherein a center of the second ejection port part, in a liquid supply direction from the liquid supplying port to the energy effect chamber, is offset from a center of the heat generating element in the liquid supply direction toward a far-end side of the energy effect chamber in the liquid supply direction.

10. A liquid ejecting method for printing by ejecting liquid from a liquid ejection head, the method comprising the steps of:

preparing the liquid ejection head, the liquid ejection head including an ejection port part for ejecting liquid, a heat generating element for generating heat energy used for ejecting liquid, the heat generating element being formed at a location directly opposed to the ejection port part, an energy effect chamber in which the heat generating element is arranged, a channel communicating with the energy effect chamber, and a liquid supplying port communicating with the channel and supplying liquid to the energy effect chamber, wherein the ejection port part includes a first ejection port part communicating with atmosphere and a second ejection port part having a cross-sectional area orthogonal to a direction in which liquid is ejected that is greater than the cross-sectional area of the first ejection port part, the second ejection port part being located between the energy effect chamber and the first ejection port part, a center of the second ejection port part, in a liquid supply direction from the liquid supplying port to the energy effect chamber, being offset from a center of the heat generating element in the liquid supply direction toward a far-end side of the energy effect chamber, in the liquid supply direction; and ejecting liquid while causing a bubble generated by the heat generating element to communicate with atmosphere.

* * * * *